United States Patent [19]

Bunger

[11] Patent Number: 4,467,715

[45] Date of Patent: Aug. 28, 1984

[54] MOISTURE REDUCING RAM PRESS

[76] Inventor: Richard E. Bunger, 5202 E. Washington St., Phoenix, Ariz. 85034

[21] Appl. No.: 470,769

[22] Filed: Feb. 28, 1983

[51] Int. Cl.[3] ..... B30B 9/04

[52] U.S. Cl. ..... 100/45; 100/49; 100/51; 100/116; 100/125; 100/218; 100/215

[58] Field of Search ..... 100/45, 49, 51, 215, 100/37, 110, 116, 125, 240, 218, 253, 43, 117, 245

[56] References Cited

U.S. PATENT DOCUMENTS

| | | | |
|---|---|---|---|
| 203,880 | 5/1878 | Blossom | 100/295 X |
| 567,635 | 9/1896 | Blanchard | 100/125 X |
| 1,071,020 | 8/1913 | Bartholomew | 100/116 |
| 3,982,483 | 9/1976 | Bird et al. | 100/117 |
| 4,007,677 | 2/1977 | Fox | 100/45 |

*Primary Examiner*—Billy J. Wilhite

*Attorney, Agent, or Firm*—Warren F. B. Lindsley

[57] ABSTRACT

A power operated press for moist, fibrous waste employing a pair of spaced grates which are moved relative to each other only when a waste collection chamber above the press discharges to a space between the grates a predetermined amount of waste. A ram is provided for moving the grates relative to each other to compress the waste and remove a predetermined amount of moisture therefrom in timed sequence with the movement of the waste into and out of the press.

3 Claims, 7 Drawing Figures

MOISTURE REDUCING RAM PRESS

BACKGROUND OF THE INVENTION

One of the problems encountered in separating the solid and liquid elements of compressible animal waste and plant tissue is the press which is needed to control the moisture content of the solid portion of the compressed matter. Prior art presses require the time consuming necessity of disassembling the entire press for repair or replacement of worn parts at frequent intervals caused by the fibrous and abrasive characteristics of the animal tissue, waste or other matter being processed.

DESCRIPTION OF THE PRIOR ART

Many types of machines or presses have been developed and are available for use in separating and extracting the liquid contents or juices from various kinds of animal or vegetable tissue, such as meat, fish, fruit, nuts and many types of vegetables. These machines or presses are usually quite complicated, expensive to purchase and maintain in good working order for substantial periods of production time; and therefore their use is not feasible, expeditious or efficient enough to perform the specific function of processing such highly abrasive and fibrous matter as animal waste.

U.S. Pat. No. 3,982,483 discloses a press which utilizes the principal of the "Archimedian-Screw" in association with a screen for separating the solid and liquid elements of compressible animal or vegetable tissue and for controlling the moisture content of the resulting product.

This press employs replaceable shoes on the flight assembly which require time and labor to periodically replace. Thus, a need exists for a press that greatly reduces the number of wearing parts, thereby reducing the down time and labor necessary to continually perform the dewatering and moisture controlling operation.

FIELD OF THE INVENTION

Although the machine or press of the present invention has been designed and constructed for the specific purpose of processing and controlling the moisture content of highly abrasive, fibrous material, such as animal waste, and to withstand the abrasive use to which it will be applied for long periods of time, it should be understood that it can be utilized with efficient and satisfactory results in the processing of other material or matter having abrasive and non-abrasive fibrous characteristics.

SUMMARY OF THE INVENTION

It is, therefore, one object of this invention to provide an improved machine or press capable of processing highly abrasive and fibrous materials.

Another object of this invention is to provide an improved press usable for separating the solid and liquid elements of compressible materials to limit or control the amount of moisture retained in its solid end product.

A further object of this invention is to provide a new and improved power driven ram press which is designed to operate on a demand-sequence basis.

A still further object of this invention is to provide a new and improved ram driven press which is controlled to hold the compressible material under a given adjustable pressure for a predetermined period during its cycle of operation to provide time for water to move through the fiber matrix of the material being pressed.

A still further object of this invention is to provide a novel ram driven press which employs top and bottom slide gates which open and close in timed relationship with the movement of the ram to allow the introduction into the press of new material after the pressed solids fall through the bottom gate into a discharge hopper.

A still further object of this invention is to provide a new and novel ram driven press that employs cooperating bar screens, one stationary and the other mounted on the free end of the ram through which the moisture is forced under pressure from the fibrous material during the pressing operation.

Further objects and advantages of the invention will become apparent as the following description proceeds; and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings, in which.

DESCRIPTION OF THE PREFERRED EMBODIMENT

Figures 1, 2, 4D:
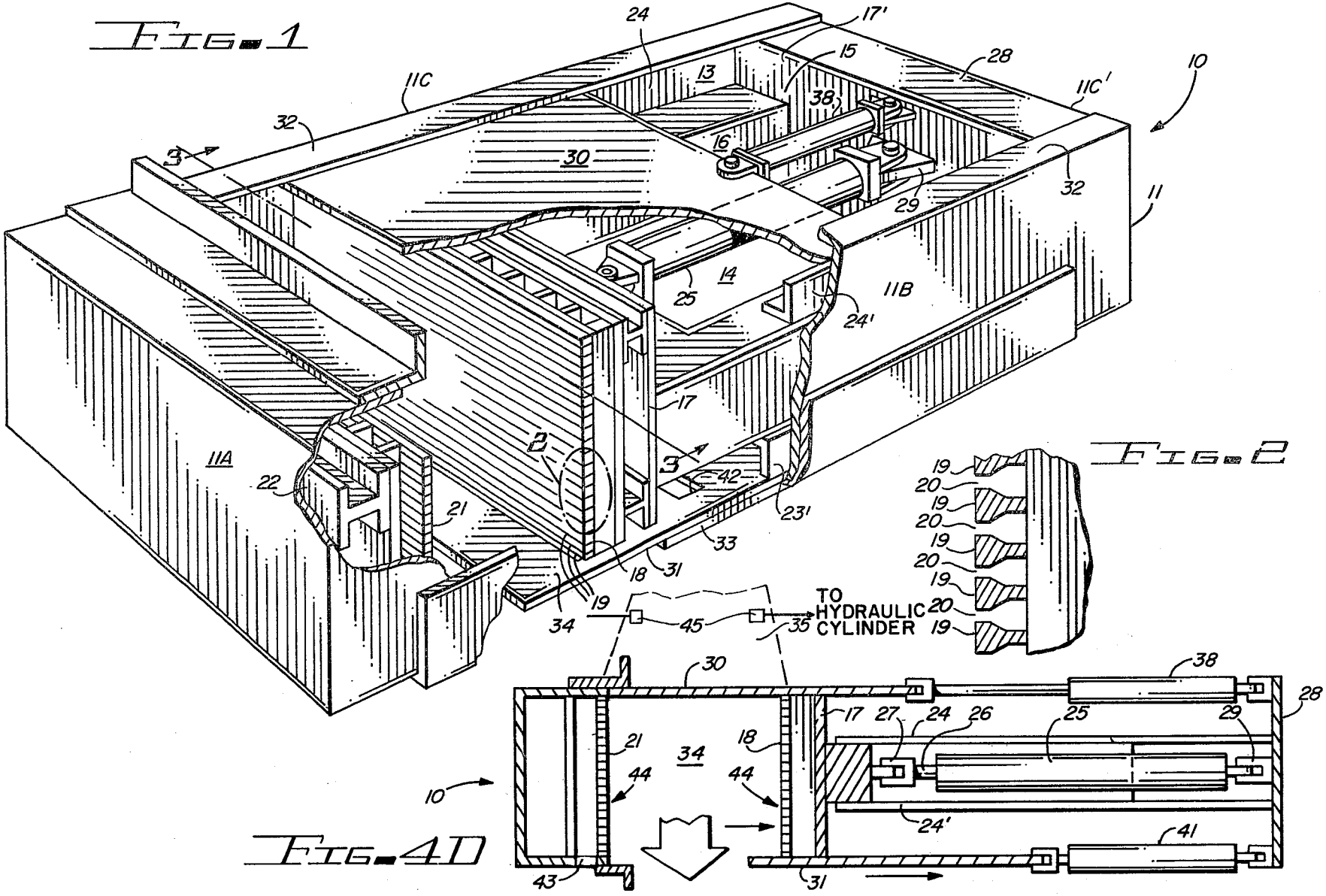
FIG. 1 is a perspective view of a machine or press embodying the invention.
FIG. 2 is an enlarged view of the circled area of FIG. 1 identified by the numeral 2.
FIGS. 4A–4D are diagrammatic, cross-sectional views of the press shown in FIG. 1 in a sequence of operating stages.
Figure 3:
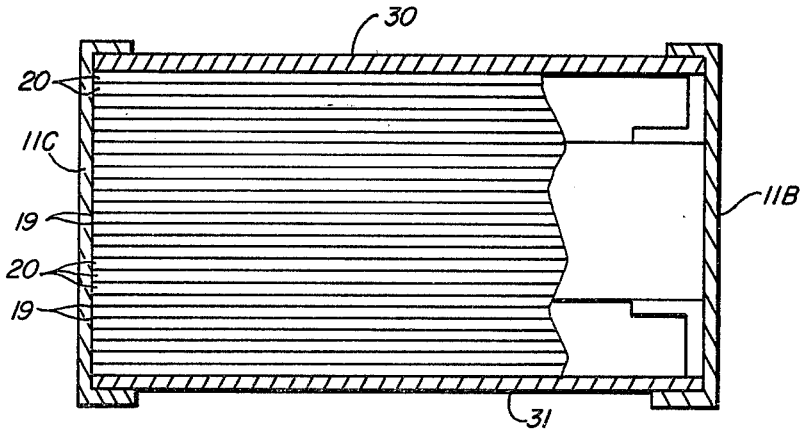
FIG. 3 is a cross-sectional view of FIG. 1 taken along the line 3—3 with a part broken away to show further detail of the structure.

Referring more particularly to the drawings by characters of reference, FIGS. 1 and 2 disclose a machine or press 10 comprising a frame 11 which may be supported by two pairs of vertically positioned legs (not shown). The frame defines an open trough 13 within which a ram 14 is arranged to move longitudinally thereof.

Ram 14 comprises an open frame 15 formed by a pair of longitudinal, parallel side members 16 and a pair of parallel, transversely-arranged end members 17, 17'. End member 17 is provided with a pressure face 18 formed in the configuration of a screen or grate comprising a plurality of parallelly and spacedly-arranged bars 19 forming passageways 20 therebetween through which a part of the water draining from the pressed matter is expelled.

A second screen or grate 21 is provided for cooperating with grate 18 and is mounted juxtapositioned to a support frame 22, both of which are secured in trough 13 of frame 11 to frame end 11A, as shown.

Ram 14 is mounted within trough 13 of frame 11 on and between spaced, parallelly-arranged ram guides 23, 23'and 24, 24'. These guides mounted on the inside surfaces of the longitudinal sides 11B and 11C of frame 11 form the track on and between which ram 14 reciprocates.

A hydraulic cylinder 25 is mounted within frame 15 of ram 14 axially thereof with one end of its piston rod 26 fastened by means of a shoe 27 to end 17 of frame 11.

The opposite end of the hydraulic cylinder 25 is secured to a reinforcing backing or thrust block 28 fastened to the inside surface of end 11C'of frame 11 by a fastening means 29.

Ram 14 moves along rails 23, 23'toward grate 21 a predetermined distance which is controlled by the length of the piston rod 26 of hydraulic cylinder 25 and the connection of the hydraulic cylinder to thrust block 28. Thus, a given size gap exists between grates 18 and 21 when the piston rod 26 of the hydraulic cylinder 25 has reached the end of its stroke in its movement toward grate 21.

Further, a larger gap exists when the piston rod 26 is fully retracted within the hydraulic cylinder 25 when it moves in the opposite direction.

To facilitate the loading and unloading of the press, a pair of slide gates 30 and 31 are mounted on the top and bottom, respectively, of frame 11 in tracks 32 and 33, respectively. These tracks are secured to the sides 11B and 11C, as shown in the drawings.

Each slide gate is movable along its track to open and close an opening in frame 11 associated therewith, which opening provides a passageway into or out of a gap 34 positioned between grates 18 and 21. Each gate is actuated by a hydraulic cylinder in a time sequence controlled by a control panel (not shown) mounted on or adjacent to frame 11 of press 10.

Figure 4A:
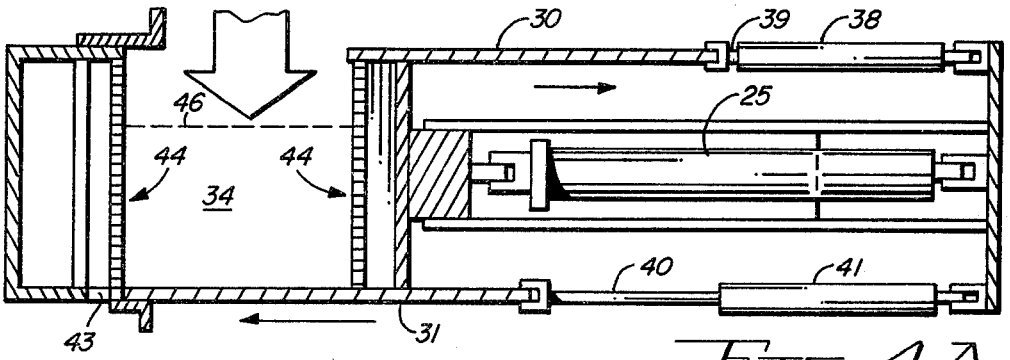
Figure 4B:
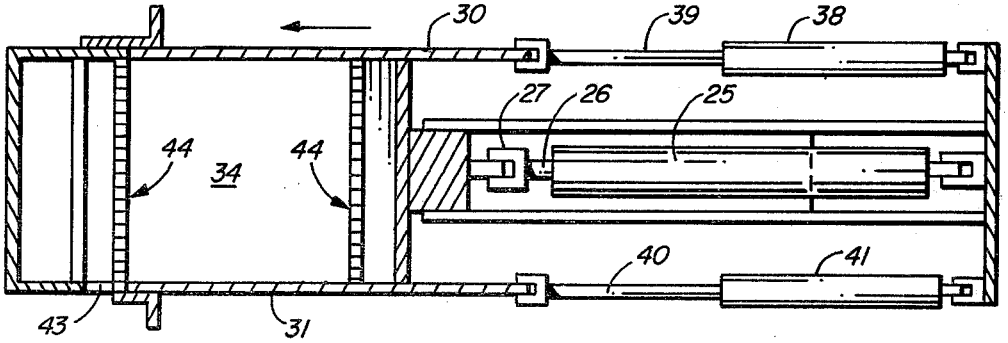

As shown by the arrows in FIGS. 4A and 4D of the drawings, wet waste 46 accumulated from a source such as, for example, the floor of a confinement pen for cattle, is transferred to a collection chamber 35 shown in dash lines on the top of press 10 by a conveyor (not shown) and dropped into a gap 34 of the press between grates 18 and 21 when the piston of the hydraulic cylinder 25 is fully withdrawn into the cylinder, as shown in FIG. 4A.

This wet waste comprising substantially 85 to 95% water is pressed between grates 18 and 21 by ram 14 into a comparatively dry material having a range of 50 to 75% moisture.

The disclosed press is designed to operate on a demand-sequence basis, i.e. it runs when needed and then shuts down. This press is particularly designed for operation with a flumed platform waste removal system used in modern cattle confinement facilities where the defecation pattern of the animals is irregular. The animals tend to defecate about 50% of their total solid production within the first three hours after sunrise and about 30% in the last three hours before and one hour after sunset. The 20% balance may occur at any time during the day or night. If the animals are disturbed at any time during their rest periods, day or night defecation occurs. Because of the unpredictable surge of waste material, the press was designed to operate on a demand-sequence basis using power only when actuated.

Thus, the press sets idle with gate 30 closed, being actuated thereto by a suitable reciprocating means, such as a hydraulic cylinder 38. Hydraulic cylinder 38 comprises a piston rod 39 connected at its free end to gate 30 and having its cylinder connected to frame 11 at its other end.

Gate 31, as shown in FIG. 4A, is closed with it actuated there previously by the piston rod 40 of a hydraulic cylinder 41.

Wet waste 46 is accumulated in collection chamber 35 until it is filled to a capacity which is sensed and controlled by a suitable sensor 45. When this chamber is filled, sensor 45 energizes a hydraulic pump motor (not shown) which causes the hydraulic cylinder 38 to open gate 30, as shown in FIG. 4A. The waste 46 then falls into chamber 34 and gate 30 closes. The closing of gate 30 actuates hydraulic cylinder 25 to start its pressing cycle.

Figure 4C:
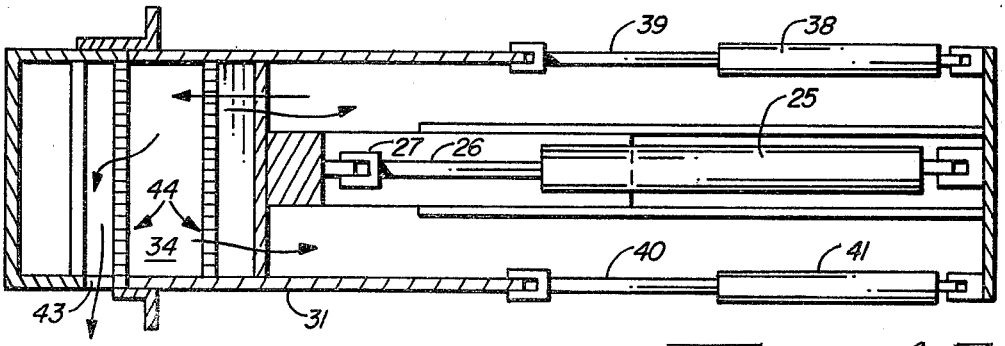

The main ram 14 compresses the waste between grates 18 and 21 until a predetermined pressure is reached, as shown in FIG. 4C, at which time a timer on the control panel of the press (not shown) is actuated. The ram of the press at this predetermined pressure is stationary and maintains this pressure for a predetermined period of time. The predetermined pressure is adjustable to allow for the different pressure requirements of different fibers. The total pressure time is also adjustable by merely dialing in a different time setting. Each waste product has a different time requirement to allow water to move through the fiber matrix.

When the time setting of the timer has expired, it then causes the ram 25 to retract which then causes the bottom gate 31 to open, as shown in FIG. 4D, and the pressed solids to drop out of the press chamber 34, i.e. gap 34 between grates 18 and 21, to a discharge auger or a discharge hopper. The bottom gate 31 is held open for a predetermined period of time to allow the pressed solids to fall clear, and then it automatically closes with the main ram 14 at its fully retracted position.

The power to the press motor is then turned off and the press is now ready for another cycle of operation.

It should be noted that the fibrous waste behaves as a filter medium to filter out and hold small particulates that are even smaller than the space or passageways 20 between the bars 19 of grate 18. By setting the pressure to its highest setting of approximately 2000 to 4000 pounds per square inch and then holding the pressure until no more water is drained from the waste material, a very dry, crumbly product will result from the pressing operation. Dairy and beef cattle waste material pressed to a 70–75% moisture content can usually be accomplished with a 1000 to 1200 pounds per square inch setting for a pressing period of approximately 10 to 30 seconds.

The liquid that is pressed through the bars forming the grates 18 and 21 is drained through suitable drain holes 42 and 43, respectively, in the bottom of frame 11 and used for flush water in the waste collecting system of confinement pens from which the animal waste is received or is drained to a lagoon for land irrigation and fertilizing purposes.

As shown more clearly in FIG. 2, the bars 19 of grates 18 and 21 may be of a T-shaped configuration with the passageways 20 therebetween being of a similar shape. These spacings between the bars at the surfaces of the grates may be 0.005 to 0.20 inches in width, depending on the waste being handled.

As shown in FIG. 2, the bars 19 of the grates form T-shaped configurations with the cross member of the T forming the pressing surface of the grate and the openings 20 of the grates being wider downstream of the grate pressing surface 44 than at the grate surface.

The size of the press is based on the maximum amount of waste generated in the associated animal pen during any 24-hour period. The hydraulic cylinder 25 and ram 14, associated pump and motor is sized to handle the maximum projected solids production of the associated animal pen.

Although but one embodiment of this invention has been illustrated and described, it will be obvious to one skilled in the art that various changes may be made in the structure shown without departing from the spirit of the claimed invention.

What is claimed is:

1. A press for extracting liquid from waste material comprising:

a frame forming a trough opened at one end to form a waste receiving inlet port and a compressed waste discharging outlet port, a pair of movable gates, one of which opens and closes each of the inlet and outlet ports in a predetermined sequence, means for moving said gates to open and closed positions, said means for moving each of said gates comprising a hydraulic cylinder mounted within said trough, a pair of spacedly-arranged grates mounted within said trough at said one end to define therebetween a waste receiving and waste compressing chamber, the inlet and outlet ports opening into and out of said chamber, a ram operable by a hydraulic cylinder mounted in said trough for reciprocal movement longitudinally thereof, said ram being fastened to one of said grates for moving it relative to the other grate, each of said grates comprising a plurality of spacedly-arranged bars forming passageways therebetween for draining liquid pressed from the waste upon predetermined movement of said grates, the bars of said grates comprising T-shaped configurations with the cross member of the T forming the pressing surface of the grate, and the openings between the spacedly arranged bars of said grates being wider downstream of the grate surface than at the grate surface, drain openings in said frame adjacent each of said grates for removing from said frame the liquid pressed out of the waste, and means for moving said ram to cause relative movement of said grates to provide a controlled pressing operation on the waste.

2. The press set forth in claim 1 in further combination with:

a sensor means on said frame for sensing when said chamber is full for actuating the hydraulic cylinders to open said gates and actuate said ram.

3. The press set forth in claim 2 wherein:

said sensor means is mounted above said chamber.

* * * * *